US011078656B2

(12) United States Patent
Dhamija et al.

(10) Patent No.: US 11,078,656 B2
(45) Date of Patent: Aug. 3, 2021

(54) LEAKAGE PROOF, WATER SAVING FLUSHING DEVICE

(71) Applicants: Jagdish Kumar Dhamija, New Delhi (IN); Manish Dhamija, New Delhi (IN)

(72) Inventors: Jagdish Kumar Dhamija, New Delhi (IN); Manish Dhamija, New Delhi (IN)

( * ) Notice: Subject to any disclaimer, the term of this patent is extended or adjusted under 35 U.S.C. 154(b) by 0 days.

(21) Appl. No.: 16/611,698

(22) PCT Filed: Aug. 3, 2017

(86) PCT No.: PCT/IB2017/054755
§ 371 (c)(1),
(2) Date: Nov. 7, 2019

(87) PCT Pub. No.: WO2018/211317
PCT Pub. Date: Nov. 22, 2018

(65) Prior Publication Data

US 2020/0109544 A1 Apr. 9, 2020

(30) Foreign Application Priority Data

May 17, 2017 (IN) ..... 201711017238

(51) Int. Cl.
*E03D 5/09* (2006.01)

(52) U.S. Cl.
CPC ..... *E03D 5/09* (2013.01)

(58) Field of Classification Search
CPC .... E03D 5/09; E03D 5/00; E03D 5/02; E03D 5/024; E03D 5/092; E03D 1/35; E03D 1/34; E03D 1/144; F16K 33/00
USPC ..... 4/413
See application file for complete search history.

(56) References Cited

U.S. PATENT DOCUMENTS 335,022 A * 1/1886 D'Esté ..... E03D 1/34 4/411
477,716 A * 6/1892 Turner ..... E03D 1/34 4/388
524,176 A * 8/1894 Liming ..... E03D 1/34 4/394

(Continued)

OTHER PUBLICATIONS

International Search Report issued in International Patent Application No. PCT/IB2017/054755 dated Jan. 10, 2018.

*Primary Examiner* — Benjamin R Shaw
(74) *Attorney, Agent, or Firm* — United IP Counselors, LLC

(57) ABSTRACT

The present invention provides a leakage proof, water saving flushing device for effectively managing water resources through an interlocking mechanical assembly. The said interlocking mechanical assembly is made up from a water channel gate arm having a distal end and a gate end, and a floating air pocket arm having a floating air pocket end and a distal end. Wherein, the distal end of the said floating air pocket arm is placed perpendicularly against the said distal end of the said water channel gate arm and provides an interlocking mechanism. The said interlocking mechanical assembly also comprises an operating element adapted for providing a push force to an elongated connecting arm, wherein the said elongated connecting arm provides a push force to unlock the said interlocking mechanical assembly.

17 Claims, 8 Drawing Sheets

(56) References Cited

U.S. PATENT DOCUMENTS

| | | | | | |
|---|---|---|---|---|---|
| 2,819,471 | A * | 1/1958 | Ezzell | E03D 1/308 | 4/382 |
| 3,768,103 | A * | 10/1973 | Robinson | E03D 1/145 | 4/326 |
| 3,945,057 | A | 3/1976 | Therkelsen | | |
| 4,232,408 | A * | 11/1980 | Chen-Yuan | E03D 1/144 | 4/325 |
| 4,296,505 | A * | 10/1981 | Chien-Sheng | E03D 1/144 | 4/324 |
| 4,620,331 | A * | 11/1986 | Sagucio | E03D 1/144 | 4/324 |
| 5,020,167 | A * | 6/1991 | Harris | E03D 1/144 | 4/325 |
| 5,265,282 | A | 11/1993 | Schmucki | | |
| 5,291,620 | A * | 3/1994 | Gilley | E03D 5/09 | 137/397 |
| 5,524,297 | A * | 6/1996 | Harrison | E03D 1/144 | 4/325 |
| 5,669,082 | A * | 9/1997 | Sun | E03D 1/144 | 4/324 |
| 6,263,520 | B1 * | 7/2001 | Song | E03D 1/142 | 4/324 |
| 2003/0074727 | A1 * | 4/2003 | Hand | E03D 5/02 | 4/326 |
| 2004/0064879 | A1 * | 4/2004 | Hand | E03D 1/306 | 4/300 |
| 2006/0053542 | A1 * | 3/2006 | Hand | E03D 1/145 | 4/325 |
| 2006/0218712 | A1 * | 10/2006 | Nichols-Roy | E03D 1/34 | 4/378 |
| 2017/0260727 | A1 * | 9/2017 | Huang | E03D 1/34 | |

* cited by examiner

LEAKAGE PROOF, WATER SAVING FLUSHING DEVICE

TECHNICAL FIELD

The present invention relates to a water flushing device for effectively preventing water leakage and saving precious water resources. More specifically, the invention provides a leakage proof flushing device having interlocking flushing mechanism which operates mechanically and prevents water wastage due to leakage before and after a flushing operation.

BACKGROUND OF THE DISCLOSURE

Water is an important life supporting component on earth and continuous availability of fresh water is the backbone of a civilized society. Water is required for irrigation, construction, cleaning, cooling and drinking purpose. Hence, it is very important for effectively managing the water resources. Water is abundantly used for day to day cleaning purposes such as urinals and toilets, bathing and washing. In the present time, every apartment, office and other public place, even transport system also has the facility of urinals and toilets for maintaining a clean ambiance. However, maintaining such clean ambiance always requires water flushing of human excreta via a water flushing device. Frequent use of water flushing also requires a leakage proof mechanism deployed within the said flushing device.

The water flushing devices are of many types such as single flush and multiple flush. The water flushing devices also includes various working mechanisms such as tank fill flush, tank less flush, flasher flush, siphon flush, high pressure flush, clamshell flush etc. Furthermore, all the flushing devices include a mechanical assembly and the functionality of a particular flushing device is based on the mechanism provided within that flushing device. Every mechanical assembly is designed to provide a complete water leakage proof environment.

Further, there are verities of flushing devices available worldwide but the every flushing device has its own flushing mechanism with limited life span. Normally, the flushing device works well during the very initial days of its installation. However, after couple of months the said flushing device starts leakage of water because of the continuous usages. Further the use of the flushing device is consistent as the said flushing device is to be operated couple of times a day at home, office and there is no limit of the repetition of use of the flushing devices installed in the public places so the operational repetition of flushing device is very consistent.

Due to the consistent and continuous usages, the mechanical assembly of the flushing device gets distorted and stops working properly and thus starts continuous leakage of water. Further, the presently used flushing devices do not provide any suitable mechanism to prevent wastage of water due to leakage during a resting condition i.e. before and after the flushing operation.

Accordingly, there is a need of a fully leakage proof flushing device to save a huge volume of water being wasted in our daily life.

Water is available in abundant volume on the planet earth but the availability of usable and potable water is very limited on the planet earth, in other words water is one of the most important life components on the planet earth. Hence there is a strong need for such systems which are helpful to stop water leakage, water wastage and regulate water usage.

Further a leakage proof flushing device is required to save water and regulate water usage for the wellbeing of all organisms on earth.

The present invention overcomes all drawbacks of the current flushing devices, and helps in saving water, regulate usage of water and can also use multiple volumes of flushing water according to the needs of the user. So one don't need to bother the usage and wastage of water as being fully leakage proof flushing device.

SUMMARY

The following presents a simplified summary of the claimed subject matter in order to provide a basic understanding of some aspects of the claimed subject matter. This summary is not an extensive overview of the claimed subject matter. It is intended to neither identify key or critical elements of the claimed subject matter nor delineate the scope of the claimed subject matter. Its sole purpose is to present some concepts of the claimed subject matter in a simplified form as a prelude to the more detailed description that is presented later.

In view of the aforesaid needs and shortcoming of the state of the art in an aspect, the present invention provides a flushing device for saving water and preventing water leakage.

It will be apparent to a person skilled in the art that the water flushing device as disclosed in the present invention is adapted to overcome the problem of water leakage in the currently used flushing devices. Further, the present invented water flushing device also regulates the use of water and provides option for multiple volumes of flushing water according to the needs of the user. Thus, the present invented water flushing device is also adapted for effectively managing water resources.

The present invented water flushing device comprises an elongated hollow body member and an interlocking mechanical assembly placed alongside of the said elongated hollow body member.

In an embodiment, the said elongated hollow body member is longitudinally placed inside a flushing water body and having a top end and a bottom end. Further, the said elongated hollow body member includes water channel openings placed at a peripheral position alongside of its length.

In an embodiment, the said interlocking mechanical assembly along with the said hollow body member of the water flushing device is adapted for effectively managing the water resources.

In an embodiment, the said interlocking mechanical assembly comprises an operating element, an elongated connecting arm, a water channel gate arm and a floating air pocket arm. Wherein, the said operating element is a push button and is in communication with the said elongated connecting arm. The said operating element is adapted for providing a push force to the elongated connecting arm. In an operational condition, the said operating element is pushed by the user to make a displacement of the elongated connecting arm to initiate the operation of the water flushing device for effectively managing water resources.

In an embodiment, the said water channel gate arm includes a distal end and a gate end. Wherein, the said gate end is adapted for tightly holding the said water channel gate at an inclined angel over the water channel opening of the said elongated hollow body member. Further, the said water channel gate also includes a rubber part configured around the periphery thereof. Wherein, the said rubber part is adapted to provide a waterproof fixture of the said water channel gate over the said water channel opening. Furthermore, the said water channel gate also includes an iron body weight configured thereof. Wherein, the said iron body weight is adapted to provide an extra sealing strength to the said waterproof fixture of the said water channel gate over the said water channel opening.

In an embodiment, the said floating air pocket arm includes a floating air pocket end and a distal end. The said floating air pocket end comprises a floating air pocket. Wherein, the distal end of the said floating air pocket arm is placed perpendicularly against the said distal end of the said water channel gate arm to provide an interlocking mechanism between the said water channel gate arm, and the said floating air pocket arm.

Specifically, the water channel gate arm and the floating air pocket arm both are interconnected, more specifically the distal end of both water channel gate arm and the distal end of the floating air pocket arm are placed perpendicular to each other and plays a key role in the interlocking mechanism.

In an embodiment, the said water channel gate arm is adapted for opening and tightly closing the water channel via the said water channel gate arm. On the other hand, the said floating air pocket arm is adapted to provide an unlocking and locking condition to facilitate the opening and tight closing of the water channel gate via the said water channel gate arm. Further, the said floating air pocket of the floating air pocket arm plays a substantial role in the interlocking mechanism of the said flushing device.

In a preferred embodiment, the said elongated connecting arm is adapted to unlock the said interlocking mechanism of the said water channel gate arm and the said floating air pocket arm. The elongated connecting arm is assembled parallel alongside the length of the elongated hollow body member and comprises of a lower striking end. In an operational condition, when the said operating element is pushed by the user and the push force is applied on the said elongated connecting arm then the said lower striking end provide a push force on the said distal end of the water channel gate arm. The said push force of the lower striking end on the said the distal end of the water channel gate arm provides a back and forth pivotal movement to the said water channel gate arm and to the said floating air pocket arm.

Further, the said back and forth pivotal movement of the floating air pocket arm results into the opening of the water channel by rotating the water channel gate arm. Specifically, due to the said back and forth pivotal movement both the water channel gate arm and the floating air pocket arm rotate from actual position in the corresponding directions. More specifically, the back and forth pivotal movement of the said water channel gate arm is reciprocal to the back and forth pivotal movement of the floating air pocket arm.

In an embodiment, due to the said back and forth pivotal movement the said water channel gate arm and the said floating air pocket arm rotates at an angle of $\leq 90°$.

Further in the unlocking condition the distal ends of both the water channel gate arm and floating air pocket arm overlaps each other. More specifically the distal end of the floating air pocket arm overlaps over the distal end of the water channel gate arm and thus provides a means of holding the distal end of the water channel gate arm to allow the uplifting of the water channel gate in the upward direction.

Further the water channel gate arm and the floating air pocket arm rotates back to the locking condition.

Particularly, the present water flushing device is adapted for effectively managing water resources. More particularly, the present invention prevents water wastage and provides overall water saving, optimizing the total water demand and leakage proof flushing mechanism are some examples of the desired merits achieved by the present invention.

This together with the other aspects of the present invention along with the various features of novelty that characterized the present disclosure is pointed out with particularity in claims annexed hereto and forms a part of the present invention. For better understanding of the present disclosure, its operating advantages, and the specified objective attained by its uses, reference should be made to the accompanying descriptive matter in which there are illustrated exemplary embodiments of the present invention.

DESCRIPTION OF THE DRAWING

The advantages and features of the present invention will become better understood with reference to the following detailed description taken in conjunction with the accompanying drawings, in which.

DESCRIPTION OF THE INVENTION

Figure 1:
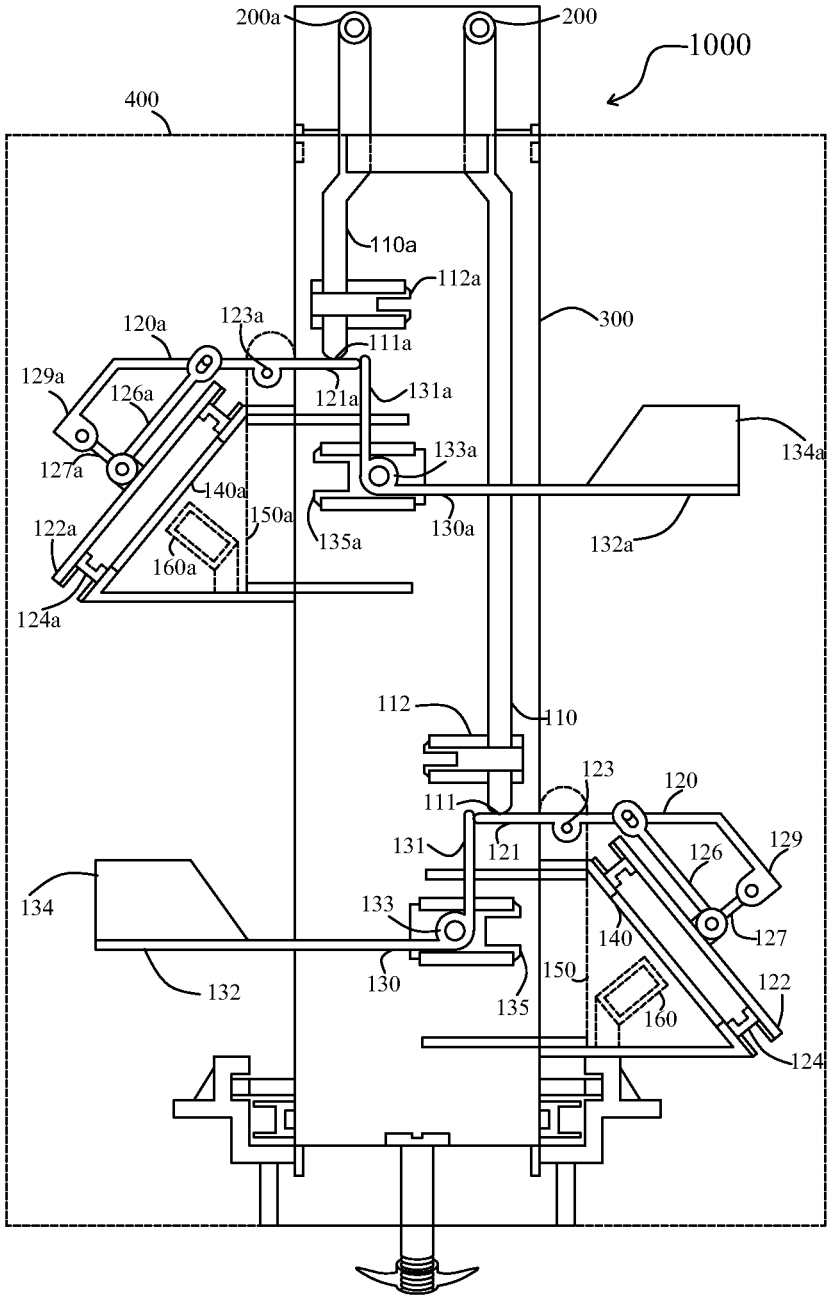
FIG. 1 illustrates the flushing device for effectively managing water resources and shows assembled view of interlocking mechanical assembly and water body of the present invention.

The invention will now be described with respect to various embodiments. The following description provides specific details for a thorough understanding of, and enabling description for, these embodiments of the invention. However, one skilled in the art will understand that the invention may be practiced without these details. In other instances, well-known structures and functions are not shown or described in detail to avoid unnecessarily obscuring the description of the embodiments of the invention.

It is intended that the terminology used in the description presented be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

The exemplary embodiments described herein details for illustrative purposes are subjected to many variations. However, it should be emphasized that the present invention is not limited to the flushing device for effectively managing water resources. It is understood that various omissions and substitutions of equivalents are contemplated as circumstances may suggest or render expedient, but these are intended to cover the application or implementation without departing from the spirit or scope of the present invention.

Unless otherwise specified, the terms, which are used in the specification and claims, have the meanings commonly used in the field of Sanitary engineering and commercial industry. Specifically, the following terms have the meanings indicated below.

The terms "a" and "an" herein do not denote a limitation of quantity, but rather denote the presence of at least one of the referenced item.

The terms "having", "comprising", "including", and variations thereof signify the presence of a component.

The term "interlocking mechanical assembly" refers to the combination of various mechanical components to form an interlocking mechanical assembly. For better understanding individual mechanical components are assembled together in such a way that they engage with each other by overlapping to perform interlocking.

The term "elongated hollow body member" refers to a mechanical component which is vertical, hollow and cylindrical in shape. For better understanding a polyvinyl chloride pipe is the best example of the elongated hollow body member.

The term "elongated connecting arm" refers to a mechanical component, which is rigid and lengthy. For better understanding mechanical shaft is the best example of the elongated connecting arm.

The term "operating element" refers to a mechanical element, operating element is a combination of mechanical components used to operate a mechanism. For better understanding door handle and push button are the best examples of operating element.

The term "corresponding direction" refers to an assigned direction of movement, in which a desired element moves in the assigned direction.

The term "rim" refers to a mechanical component adapted to carry circular rubber part, may be of any shape and material.

The term "back and forth pivotal movement" refers to a type of movement in which a pivoted component moves in forward direction and again moves in backward direction to its initial position. For better understanding two opposite motions on an axis that comprise a single cycle, working of a scissors is the best example of back and forth pivotal motion.

The term "distal end" refers to a peak end point of a component which is situated away from the center of the body of the component. For better understanding a tip of a pen, tips of the fingers (portion covered by nails), and the grooved area of the spine are the best examples of the distal end.

The term "operational condition" refers to a state of process in which the operational component to be lies in its operational condition.

The term "unlocking condition" refers to a state of process in which the component appears to be in the unlocking condition.

The term "overlapping" refers to a state of position in which one distal end of a component overlaps the distal end of another component. For better understanding venn diagram is the best example of overlapping, when one component partially covers the another component.

The pivot joint as provided herein is understood to be the connecting rivet/clip for providing rotational motion on its own axis and means of attachment between elongated hollow body and floating air pocket arm, water channel gate arm.

The term "inclined angle" refers to an angle of inclination, here the use of the inclined angle is to hold the water channel gate at an inclined angle over the water channel opening.

The water channel gate arm as provided herein is understood to be the assembly of various components and mechanisms, for opening and closing for the passing and blocking of water flow through the water flow channel.

The water channel gate as provided herein is understood to be the gate for the passage of water, may be of any shape and material, made accordingly the environmental conditions and availability of the water and its hardness.

The floating air pocket arm as provided herein is understood to be the assembly of the various components and mechanism, for locking and unlocking of the interlocking mechanical assembly. Here the use of the floating air pocket arm is to exert force on the distal end of the water channel gate arm.

The floating air pocket as provide herein is understood to be the air contained sealed hollow float. For better understanding ball cock/float ball is the best example of the floating air pocket. Here the use of the floating air pocket is to exert upward thrust to interlock the distal ends of interlocking mechanical assembly.

The "rubber part" as used herein refers to those rubber parts which are elastic in nature and fit on the rim of the water channel gate. Here the use of rubber part is to make the invention leakage proof while locking the water flow channel with the water channel gate arm.

The "magnet" as used herein refers to the magnetic material which exerts magnetic force to attract the metallic part and holds it for an infinite period of time until and unless the external force is applied against the said magnetic force.

The term "multiple flow channels" is understood to means here a plurality and combination of water flow channels.

The multiple flow channels as well understood to person skilled in the art that the multiple flow channels are to facilitate the flow of multiple volume of water from one water body to another water body.

The present limitations of having flushing devices which often start water leakage after repeated use and thus lot of usable water is wasted demands a full water leakage proof flushing device. Further, it is always desirable to find out better solutions for the water leakage problem with long lasting water flush devices.

The present invention provides a water flushing device (1000) for effectively managing water resources. Specifically, the FIG. 1 provides a water flushing device (1000) having an interlocking mechanical assembly (100) for tightly locking water channel gate (122) over a water channel opening (140).

In an embodiment as shown in FIG. 2, the said interlocking mechanical assembly (100) is mounted alongwith an elongated hollow body member (300). Wherein, the said elongated hollow body member (300) comprises at least one water channel opening (140) placed at a peripheral position thereof.

Figure 3:
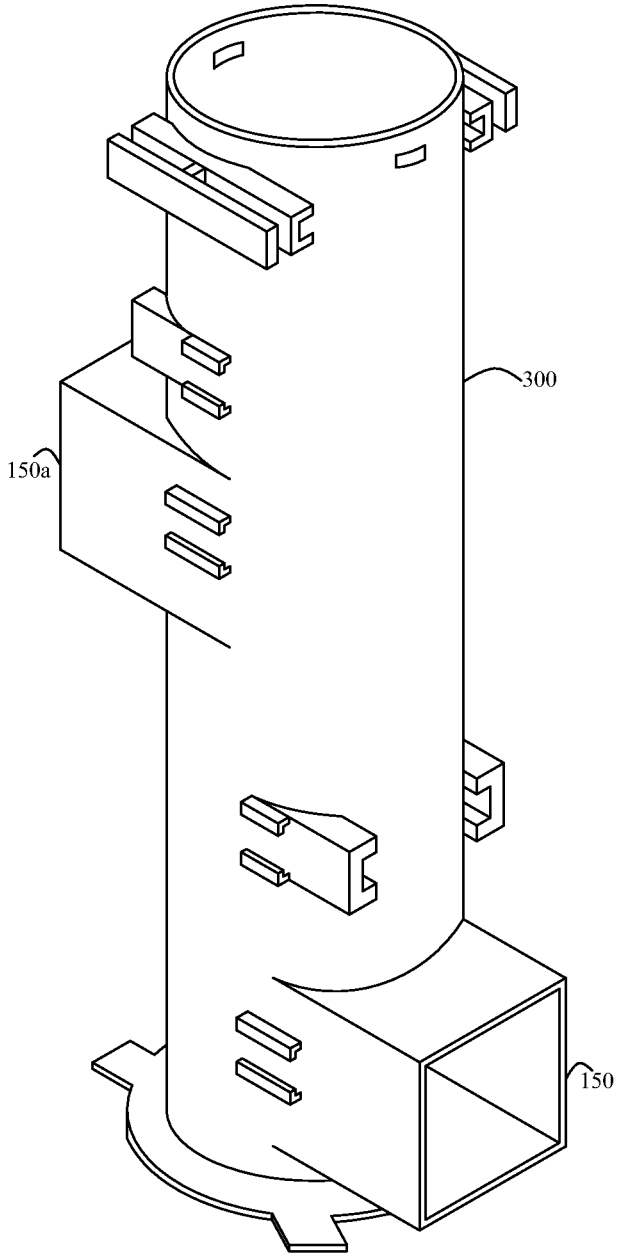
FIG. 3 illustrates the perspective view of the elongated hollow body of the present invention.
Figure 4:
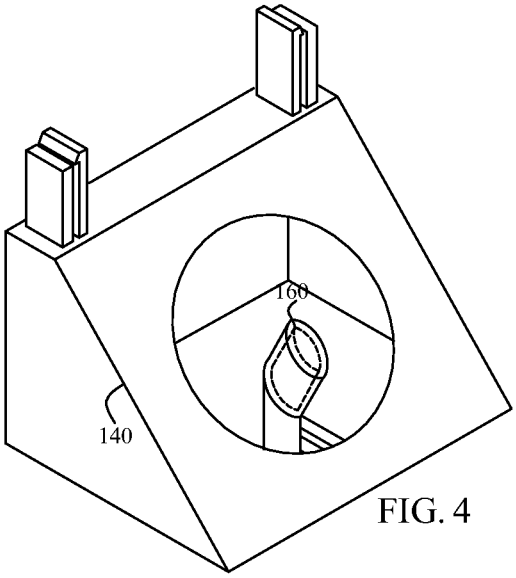
FIG. 4 illustrates the perspective view of the flow channel (140), FIG. 4*a*, FIG. 4*b
Figure 4A:
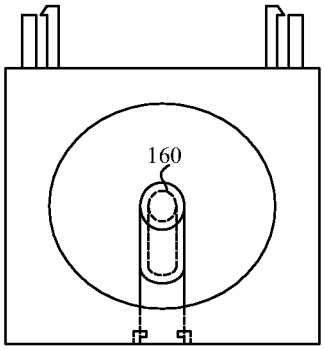
* and FIG. 4*c* shows front view, side view and back view, respectively, of the flow channel of the present invention.
Figure 4B:
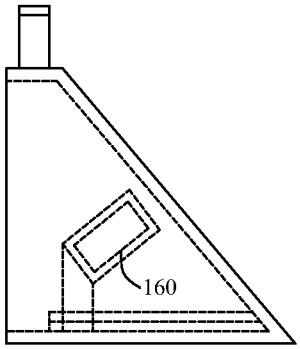
Figure 4C:
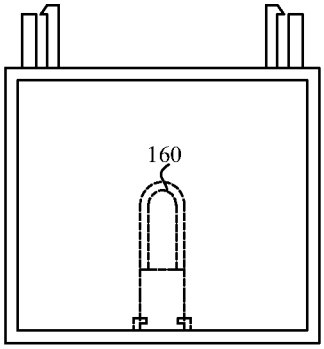

In another embodiment as shown in FIG. 3, an elongated hollow body member (300) includes at least two water channels (150), (150*a*) having at least two water channel openings (140), (140*a*) respectively.

Further, the said interlocking mechanical assembly (100) as provided herein includes a water channel gate arm (120) having a distal end (121) which lies in a horizontal plane of the ground and a gate end (129) inclined parallel over the water channel opening (140). The said gate end (129) comprises a water channel gate (122), wherein the said water channel gate (122) is adapted to provide a water tight fixture over the said water channel opening (140).

In an embodiment as shown in figure number 5-5(*b*), the said water channel gate (122) comprises a rubber part (124), a metallic part (128) and a mechanical component (125) fixed at a peripheral position thereof. Wherein, the said rubber part (124) is elastic in nature and circular in shape with a groove thereof. The said groove is adapted to provide a tight and accurate grip of the said rubber part (124) over the said mechanical component (125) as shown in the sectional views in FIG. 6-6(*c*).

Figure 6:
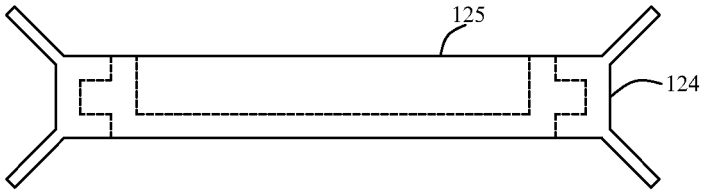
FIG. 6 illustrates the side view of an embodiment of the water channel gate (122) of the water channel gate arm (120)
Figure 6A:
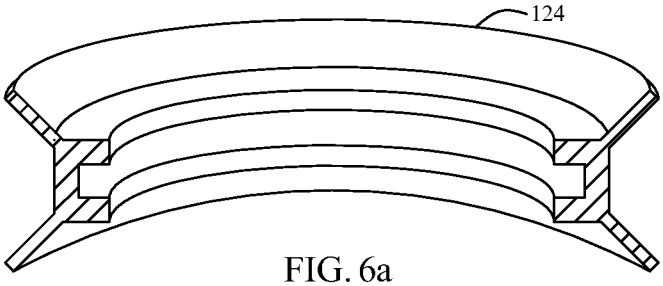
FIG. 6*a* shows the sectional view of rubber part (124)
Figure 6B:
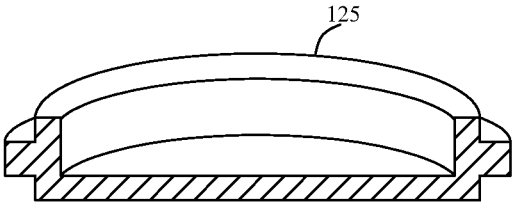
FIG. 6*b* shows the sectional view of the rim (125) of the water channel gate (122), wherein the said rim (125) is adapted for holding the said circular rubber part (124).
Figure 6C:
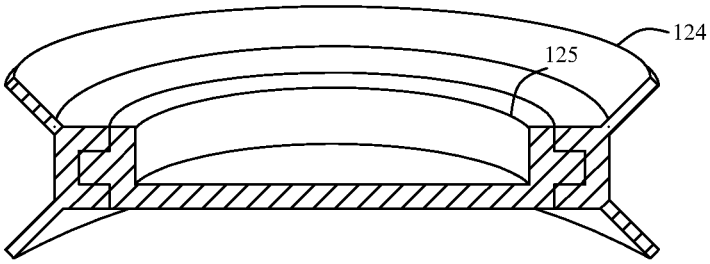
FIG. 6*c* shows the sectional view of the assembled rubber part (124) and rim (125), of the present invention.
Figure 7:
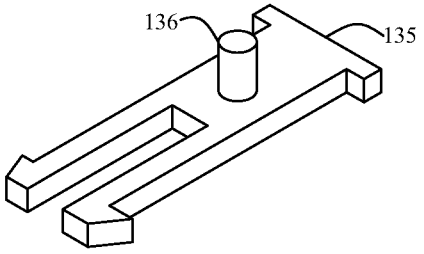
FIG. 7 illustrates the isometric view of the rivet (135), FIG. 7*a* and FIG. 7*b* illustrates top view and side view of rivet, respectively.
Figure 7A:
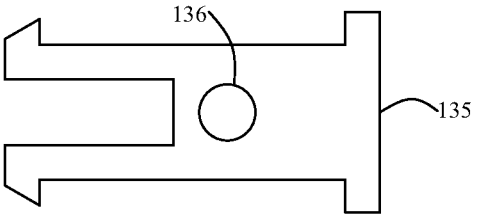
Figure 7B:
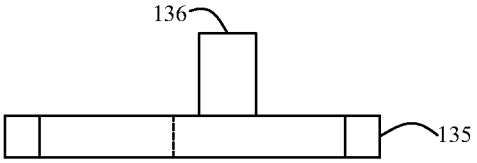
Figure 8:
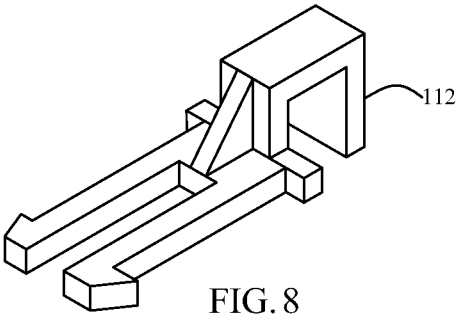
FIG. 8 illustrates the isometric view of the rivet (112), FIG. 8*a* and FIG. 8*b* illustrates top view and side view of rivet, respectively.
Figure 8A:
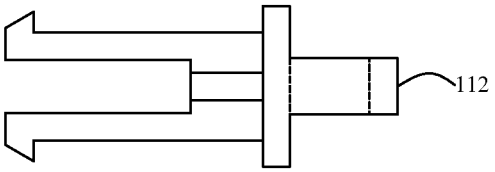
Figure 8B:
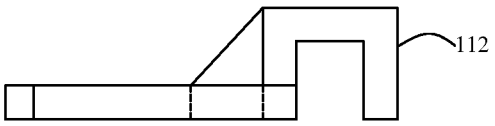

Accordingly, the rubber part (124) works as a gasket to water channel opening (140) and provides a water tight fitting of the said water channel gate (122) over the said water channel opening (140). Thus, the said rubber part (124) provides a waterproof fixture of the said water channel gate (122) over the said water channel opening (140). Specifically, as shown in FIG. 6-6(*c*), the rubber part (124) as disclosed herein is a circular rubber part (124). More specifically, the rubber part (124) is of any shape and size as per the shape and size of the water channel gate (122).

Further in another embodiment as shown in figure number 4-4(*c*), the said water channel opening (140) includes a magnetic material (160). Wherein, the said magnetic material (160) is adapted to be fixed at any position to the said water channel opening (140) such as but not limited to the a central position, and/or a peripheral position. Specifically, in the present invention the said magnetic material (160) is fixed at a central position of the said water channel opening (140).

Figure 5:
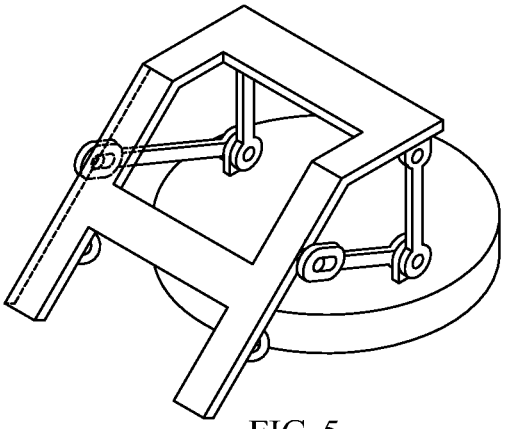
FIG. 5 illustrates the perspective view of the water channel gate arm (120), FIG. 5*a* as shown herein illustrates the side views of water channel gate arm and FIG. 5*b* as shown herein illustrates the exploded view of water channel gate (122) including metallic part (128), respectively, of the present invention.
Figure 5A:
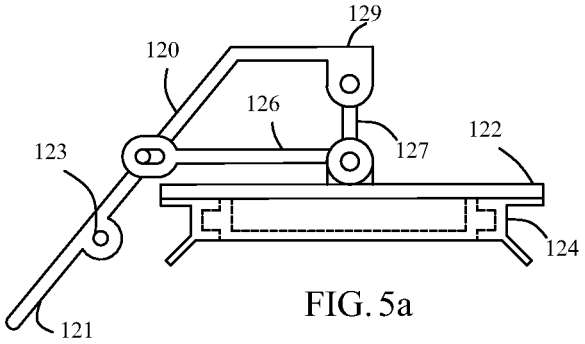
Figure 5B:
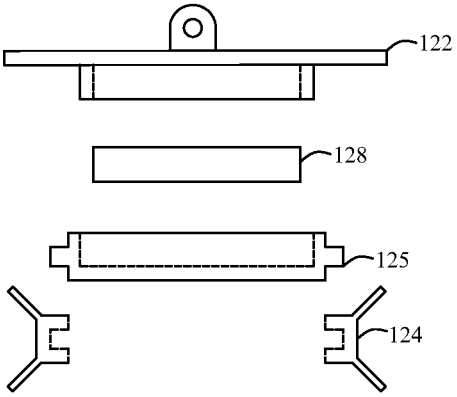

Wherein, the said magnetic material (160) is round in shape and adapted for providing an extra strength to seal the said waterproof fixture of the said water channel gate (122) over the said water channel opening (140). The magnet (160) exert magnetic force of attraction on the metallic part (128), which is inserted into the water channel gate (122) as shown in FIG. 5(*b*). During the locking position the magnetic material (160) holds the water channel gate (122) with its magnetic force of attraction on the metallic part (128).

In an embodiment as shown in figure number 1, and figure number 7-7(*b*), the water channel gate arm (120) is connected via a rivet (135) to form a pivot joint (123) and the floating air pocket arm (130) is connected via a rivet (135) to form a pivot joint (133) to a hollow body member (300).

Further, the interlocking mechanical assembly (100) includes a floating air pocket arm (130) placed in a horizontal plane of the ground and having a floating air pocket end (132) and a distal end (131). Preferably, the said floating air pocket arm (130) is "L" shaped, wherein the larger arm of the "L" shaped floating air pocket arm (130) is in the horizontal plane of the ground and the smaller arm of the "L" shaped floating air pocket arm (130) is in the vertical plane of the ground. More specifically, the larger arm of the "L" shaped floating air pocket arm (130) includes the said floating air pocket end (132) and the smaller arm of the "L" shaped floating air pocket arm (130) includes the said distal end (131).

In a specific embodiment, the said distal end (131) of the floating air pocket arm (130) is placed perpendicular to the said distal end (121) of the water channel gate arm (120). Specifically, such arrangement provides an interlocking mechanism between the said water channel gate arm (120) and the said floating air pocket arm (130). The floating air pocket arm (130) is connected via a pivot joint (133) to a hollow body member (300).

In a specific embodiment, the said interlocking mechanical assembly (100) further includes an elongated connecting arm (110), assembled parallel alongside a length of the said elongated hollow body member (300). Specifically, the said elongated connecting arm (110) is placed perpendicularly in an opposite direction to the distal end (121) of the water channel gate arm (120). Further, the elongated connecting arm (110) includes an upper operating end which is in communication with an operating element (200) and a lower striking end (111) which is in communication with the distal end (121) of the water channel gate arm (120). Wherein, in an operational condition as shown in FIG. 2(*a*) the elongated connecting arm (110) is adapted to unlock the interlocking mechanism between the water channel gate arm (120) and the floating air pocket arm (130).

Figure 2A:
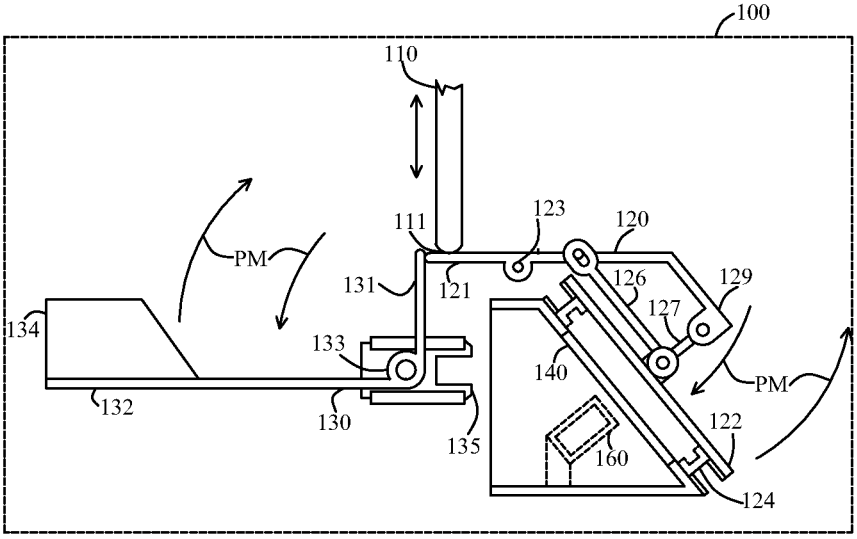
FIG. 2*a* illustrates locking condition and FIG. 2*b* illustrates unlocking condition of the interlocking mechanical assembly of the present invention.

Specifically, the said interlocking mechanical assembly (100) as shown in FIGS. 2(*a*) and 2(*b*) includes a locking condition, an unlocking condition, and a back and forth pivotal movement (PM) of each of the said water channel gate arm (120), and the said floating air pocket arm (130). More specifically, the said interlocking mechanical assembly (100) works on the basis of interlocking mechanism. Wherein the interlocking mechanism comprises of two conditions, locking condition as shown in FIG. 2*a* and unlocking condition as shown in FIG. 2(*b*).

Wherein, in the said locking condition the distal end (131) of the said floating air pocket arm (130) is placed perpendicularly against the distal end (121) of the said water channel gate arm (120). Wherein, in the said unlocking condition, the distal end (131) of the said floating air pocket arm (130) overlap the distal end (121) of the said water channel gate arm (120). Further, the said back and forth pivotal movement (PM) of the said water channel gate arm (120) is reciprocal to the said back and forth pivotal movement (PM) of the said floating air pocket arm (130).

Specifically, as shown in FIG. 2(*a*) during the said unlocking condition, a force is applied via the said elongated connecting arm (110) to push down the distal end of the said water channel gate arm. As the distal end (121) of the said water channel gate arm (120) moves downwardly then it creates a free space at an initial position of the said water channel gate arm (120) which is shown in FIG. 2(*b*).

Here it has to be understood by a person skilled in the art that the said initial position of the of the said water channel gate arm (120) is the resting condition and/or the locking condition as shown in FIG. 2(*a*). Further, it has to be understood by a person skilled in the art that during the said locking condition as shown in FIG. 2(*a*) the distal end (131) of the said floating air pocket arm (130) is placed perpendicularly against the distal end (121) of the said water channel gate arm (120). Due to the said free space, the distal end (131) of the said floating air pocket arm (130) overlaps the distal end (121) of the said water channel gate arm (120).

Further, it is to be understood by a person skilled in the art that the said overlapping provides a lifting forces to the said water channel gate arm (120), wherein due to the said lifting force the said gate end (129) of the said water channel gate arm (120) is lifted upwardly. Specifically, the gate end (129) of the said water channel gate arm (120) moves away from the said water channel opening (140), wherein the said water channel opening (140) provides a free passage to flow water from first water body to second water body and the water level goes down in first water body. The first water body as disclosed herein includes a water body from where water is required to be flushed into the second water body. Further, it is to be understood by a person skilled in the art that said upward lifting of the gate end (129) of the said water channel gate arm (120) constitutes back and forth pivotal moment (PM) of the water channel gate arm (120).

Further the device includes an operating element (200), adapted for providing a push force to the elongated connecting arm (110). The operating element (200) is in communication with the upper operating end of the elongated connecting arm (110). It is to be understood by a person skilled in the art that the said operating element (200) is selected from at least one of a push button, a handle, and/or an operating lever. Further, it is also to be understood by a person skilled in the art that the main function of the said operating element (200) is to provide a user interface for operating the said interlocking mechanical assembly (100) of the flushing device as disclosed in the present invention.

More specifically, particular in the locking condition as shown in FIG. 2*a* the distal end (131) of the floating air pocket arm (130) is placed perpendicularly against the distal end (121) of the water channel gate arm (120). It is also understood by a person skilled in the art that the said flushing device (1000) is placed inside the first water body which is full of water and during the locking condition the water provides an upward thrust to the said floating air pocket end (132) and subsequently to the said floating air pocket arm (130). This upward thrust to the said floating air pocket end (132) is provided due to floating air pocket (134) mounted on the said floating air pocket end (132). Further, the said upward thrust of the floating air pocket arm (130) provides a push force to the said distal end (131) of the said floating air pocket end (132). Due to the said push force as applied on the said distal end (131) the distal end (121) of the said water channel gate arm (120). Accordingly, both the distal end (131) of the floating air pocket arm (130) and the distal end (121) of the water channel gate arm (120) are locked against each other.

Specifically, when the water level in the first water body goes down then the said upward thrust to the said floating air pocket end (132) is lowered down and the said floating air pocket end (132) start lowering down to a normal position. Here it is to be understood that that normal position is the resting position of the said floating air pocket end (132) when the first water body only contains air. Accordingly, the said floating air pocket arm (130) gets released due to the low water level in first water body and the said distal end (131) of the floating air pocket arm (130) moves back to the locking condition via moving away from the said overlapping position to the said perpendicular position. Further, this backward movement of the said distal end (131) of the floating air pocket arm (130) also releases the said distal end (121) of the water channel gate arm (120) to the resting condition and/or the locking condition.

Particularly, it is to be understood by a person skilled in the art that the said overlapping of the said distal end (131) of the floating air pocket arm (130) and the said distal end (121) of the water channel gate arm (120) remains for a particular time period, wherein the said time period corresponds to a particular water level inside the first water body. Specifically, the particular water level inside the first water body is the lowest water level for creating a sufficient air space to lower down the said floating air pocket arm (130) to a normal position.

Figure 2B:
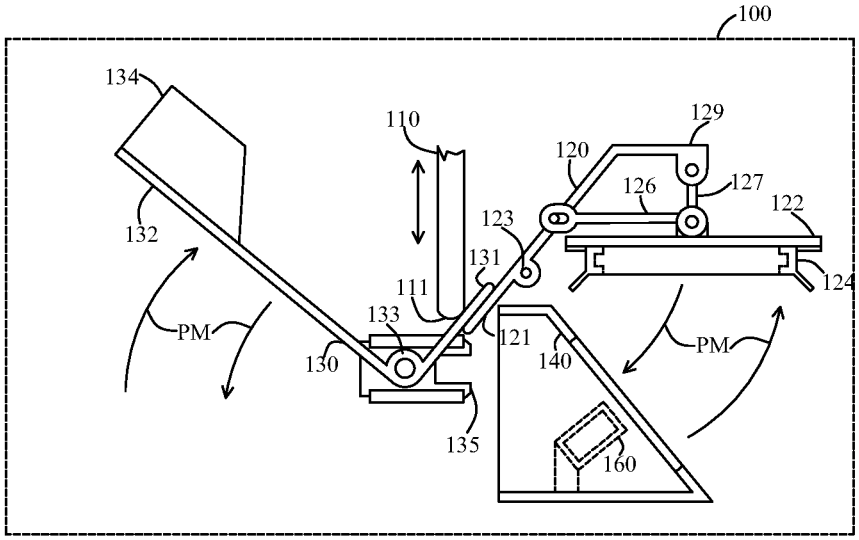

It has to be understood by a person skilled in the art that both these locking and unlocking conditions occur due to a back and forth pivotal movement (PM) of the water channel gate arm (120) and floating air pocket arm (130). The back and forth pivotal movement (PM) of the floating air pocket arm (130) is reciprocal to the back and forth pivotal movement (PM) of the water channel gate arm (120) and takes place due to the pivot joint (123) and (133) as shown in FIG. 2*a* and FIG. 2*b* respectively.

In an exemplary embodiment, the flushing device (1000) as provided by the present invention includes multiple water flow channels. It has to be understood by a person skilled in the art that such multiple water flow channels can be an even set of series or an odd set of series arranged vertically on the elongated hollow body member. The said even set of multiple flow channels includes even number of water flow channels for an example 2, 4, 6, 8 . . . N. Wherein the said odd set of multiple flow channels includes odd number of water flow channels for an example 1, 3, 5, 7 . . . N.

The present embodiment provides multiple flow channels adapted to be used as different amount of water flow channels via single flushing device. For better understanding, the present invention provides choices to the users to choose between multiple water flow channels, each water flow channel is capable of providing a different volume of water flow. The said multiple flow channels provides an advantage to save and make efficient use of water resources and enable the user to choose the suitable water flow channel according to the need of the user. For an example, in an odd series of water flow channels arranged vertically on the elongated hollow body member such as low volume at the top, medium volume at the middle/center and high volume at the bottom, which enable the user to choose among low, medium and high volume of water flow channels.

In another exemplary embodiment of the present invention, the interlocking mechanical assembly (100) is capable to be employed for controlling large scale of water bodies such as canals, dams, hydroelectric power plants, and diversions of water streams at large scale due to the versatility of the interlocking mechanical assembly (100). The said interlocking mechanical assembly (100) is further arranged in a series of multiple water flow channels.

In another exemplary embodiment of the present invention, the said interlocking mechanical assembly (100) is also capable to be employed in the distribution of canal water. The said interlocking mechanical assembly (100) is also capable to be employed as large gates at the dams, for example flood gates, levees to control and prevent water flow. The said interlocking mechanical assembly (100) can also be used in the irrigation system such as furrow irrigation, graded border irrigation, drip irrigation and/or micro irrigation. For an example, the said interlocking mechanical assembly (100) is also employed for providing controlled supply of water for irrigation via a supply tank.

In another exemplary embodiment of the present invention, the interlocking mechanical assembly (100) of the present invention is also used in the manual water tanks for the supply of the water to various pipe lines.

The foregoing descriptions of specific embodiments of the present invention have been presented for purposes of description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present invention.

The invention claimed is:

1. An interlocking mechanical assembly adapted for tightly locking a water channel gate over a water channel opening, wherein the said interlocking mechanical assembly comprises:

a water channel gate arm having a distal end and a gate end, wherein the said gate end is adapted for holding the said water channel gate at an inclined angle over the said water channel opening;

a floating air pocket arm having a floating air pocket end and a distal end, wherein the distal end of the said floating air pocket arm is placed perpendicularly against the said distal end of the said water channel gate arm to provide an interlocking mechanism between the said water channel gate arm, and the said floating air pocket arm;

an elongated connecting arm placed perpendicularly in an opposite direction to the said water channel gate arm, wherein in an operational condition the said elongated connecting arm is adapted to unlock the said interlocking mechanism between the said water channel gate arm, the said floating air pocket arm; and an operating element adapted for providing a push force to the said elongated connecting arm.

2. The interlocking mechanical assembly as claimed in claim 1 is mounted along with an elongated hollow body member, wherein the said elongated hollow body member comprises the said water channel opening placed at a peripheral position thereof.

3. The interlocking mechanical assembly as claimed in claim 1, wherein the said elongated connecting arm is assembled parallel alongside a length of the said elongated hollow body member and the said elongated connecting arm comprises:

an upper operating end, wherein the said upper operating end is in communication with the said operating element; and a lower striking end, wherein the lower striking end is in communication with the said distal end of the water channel gate arm.

4. The interlocking mechanical assembly as claimed in claim 1, wherein the said interlocking mechanism comprises:

a locking condition, wherein the distal end of the said floating air pocket arm is placed perpendicularly against the distal end of the said water channel gate arm;

an unlocking condition, wherein the distal end of the said floating air pocket arm overlap the distal end of the said water channel gate arm; and a back and forth pivotal movement of each of the said water channel gate arm, and the said floating air pocket arm, wherein the said back and forth pivotal movement of the said water channel gate arm is reciprocal to the said back and forth pivotal movement of the said floating air pocket arm.

5. The interlocking mechanical assembly as claimed in claim 4, wherein the said unlocking condition comprises steps of:

a force is applied via the said elongated connecting arm to push down the distal end of the said water channel gate arm;

the distal end of the said floating air pocket arm overlaps the distal end of the said water channel gate arm; and the gate end of the said water channel gate arm moves away from the said water channel opening, wherein the said water channel opening provides a free passage to flow water from first water body to second water body and the water level goes down in first water body.

6. The interlocking mechanical assembly as claimed in claim 4, wherein the said locking condition comprises steps of:

the said floating air pocket arm gets released due to the low water level in first water body; and the said floating air pocket arm moves back to the locking condition via moving away from the said overlapping position to the said perpendicular position, wherein the said floating air pocket arm releases the said water channel gate arm.

7. The interlocking mechanical assembly as claimed in claim 4, wherein the said back and forth pivotal movement of the said water channel gate arm is adjusted at an angle of ≤90 degree in a corresponding direction.

8. The interlocking mechanical assembly as claimed in claim 4, wherein the said back and forth pivotal movement of the said floating air pocket arm is adjusted at an angle of ≤90 degree in a corresponding direction.

9. A water flushing device adapted for effectively managing the water resources via a complete water leakage proof flushing environment, wherein the said water flushing device comprises:

an elongated hollow body member having a top end and a bottom end, wherein the said elongated hollow body member is longitudinally placed inside a flushing water body, and the said elongated hollow body member comprises at least two distantly located water channel openings placed at a peripheral position alongside of its length;

an interlocking mechanical assembly placed alongside the said elongated hollow body member, wherein the said interlocking mechanical assembly and the said elongated hollow body member forms the complete water leakage proof flushing environment, wherein the said interlocking mechanical assembly comprises a water channel gate arm having a distal end and a gate end, wherein the said gate end is adapted for holding the said water channel gate at an inclined angel over the said water channel opening, a floating air pocket arm having a floating air pocket end and a distal end, wherein the distal end of the said floating air pocket arm is placed perpendicularly against the said distal end of the said water channel gate arm to provide an interlocking mechanism between the said water channel gate arm, the said floating air pocket arm, an elongated connecting arm placed perpendicularly in an opposite direction to the said water channel gate arm, wherein in an operational condition the said elongated connecting arm is adapted to unlock the said interlocking mechanism between the said water channel gate arm, the said floating air pocket arm, and an operating element adapted for providing a push force to the said elongated connecting arm.

10. The water flushing device as claimed in claim 9, wherein the said elongated connecting arm is assembled parallel alongside a length of the said elongated hollow body member and the said elongated connecting arm comprises:

an upper operating end, wherein the said upper operating end is in communication with the said operating element; and a lower striking end, wherein the lower striking end is in communication with the said distal end of the water channel gate arm.

11. The water flushing device as claimed in claim 9, wherein the said interlocking mechanism comprises:

a locking condition, wherein the distal end of the said floating air pocket arm is placed perpendicularly against the distal end of the said water channel gate arm;

an unlocking condition, wherein the distal end of the said floating air pocket arm overlap the distal end of the said water channel gate arm; and a back and forth pivotal movement of each of the said water channel gate arm, and the said floating air pocket arm, wherein the said back and forth pivotal movement of the said water channel gate arm is reciprocal to the said back and forth pivotal movement of the said floating air pocket arm.

12. The water flushing device as claimed in claim 11, wherein the said unlocking condition comprises steps of:

a force is applied via the said elongated connecting arm to push down the distal end of the said water channel gate arm;

the distal end of the said floating air pocket arm overlaps the distal end of the said water channel gate arm; and the gate end of the said water channel gate arm moves away from the said water channel opening, wherein the said water channel opening provides a free passage to flow water from first water body to second water body and the water level goes down in first water body.

13. The water flushing device as claimed in claim 11, wherein the said locking condition comprises steps of:

the said floating air pocket arm gets released due to the low water level in first water body; and the said floating air pocket arm moves back to the locking condition via moving away from the said overlapping position to the said perpendicular position, wherein the said floating air pocket arm releases the said water channel gate arm.

14. The water flushing device as claimed in claim 11, wherein the said back and forth pivotal movement of the said water channel gate arm is adjusted at an angle of ≤90 degree in a corresponding direction.

15. The water flushing device as claimed in claim 11, wherein the said back and forth pivotal movement of the said floating air pocket arm is adjusted at an angle of ≤90 degree in a corresponding direction.

16. The water flushing device as claimed in claim 9, wherein the said water channel gate comprises a rubber part fixed at a peripheral position thereof, wherein the said rubber part provides a waterproof fixture of the said water channel gate over the said water channel opening.

17. The water flushing device as claimed in claim 9, wherein the said water channel opening comprises a magnetic material, wherein the said magnetic material is adapted for proving an extra strength to seal the said waterproof fixture of the said water channel gate over the said water channel opening.

* * * * *